United States Patent [19]

Joseph

[11] 4,279,063

[45] Jul. 21, 1981

[54] CLOTHES PEG

[76] Inventor: Clive E. Joseph, 1 Church Sq., St. Kilda, Victoria, Australia

[21] Appl. No.: 69,044

[22] Filed: Aug. 23, 1979

[30] Foreign Application Priority Data

Aug. 30, 1978 [AU] Australia ..... PD5726

[51] Int. Cl.[3] ..... D06F 55/00; B65D 21/02

[52] U.S. Cl. ..... 24/138; 206/519; 24/DIG. 29

[58] Field of Search ..... 24/138, DIG. 29; D3/29; D7/198; 16/108; 312/43; 206/519, 520, 515

[56] References Cited

U.S. PATENT DOCUMENTS

| | | | |
|---|---|---|---|
| 2,871,536 | 2/1959 | Childress | 24/23 W |
| 3,347,411 | 10/1967 | Kalata et al. | 206/519 |
| 4,102,454 | 7/1978 | Karevaara | 206/519 |
| 4,156,483 | 5/1979 | Day | 206/520 |

FOREIGN PATENT DOCUMENTS

| | | | |
|---|---|---|---|
| 601517 | 5/1936 | Fed. Rep. of Germany | 206/515 |
| 1091832 | 4/1955 | France | 24/138 R |
| 1102138 | 10/1955 | France | 24/138 R |

OTHER PUBLICATIONS

Australian Design Registration No. 74,452, Published 6/27/78.

*Primary Examiner*—Alexander Grosz

[57] ABSTRACT

Clothes peg having a body of conical shape and a set of openings in the body is disclosed. The openings are necked and decrease in size as they pass upwardly of the peg. The openings are used to secure a garment to a clothes line. The body of the peg may have a locking means for locking the pegs together to form a stack.

5 Claims, 12 Drawing Figures

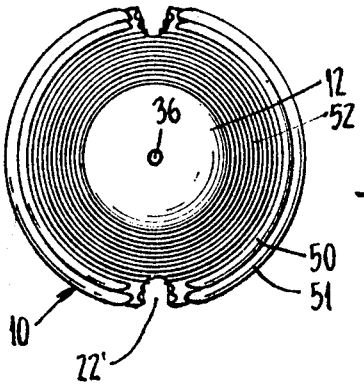
FIG. 7.
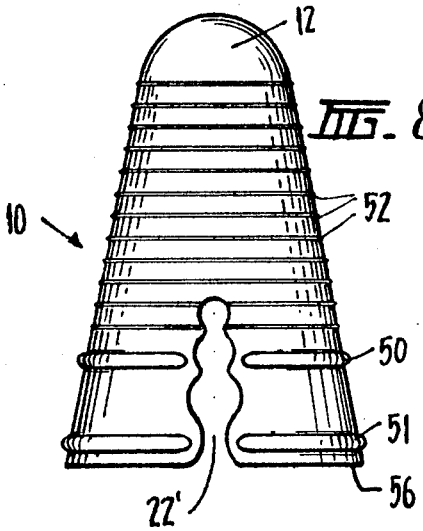
FIG. 8.
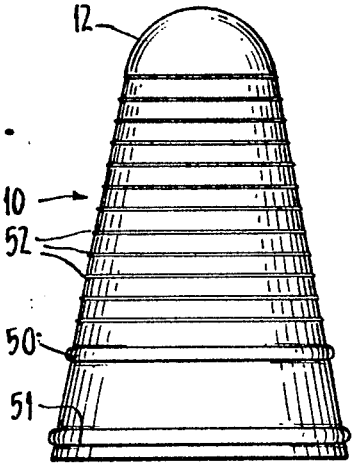
FIG. 9.
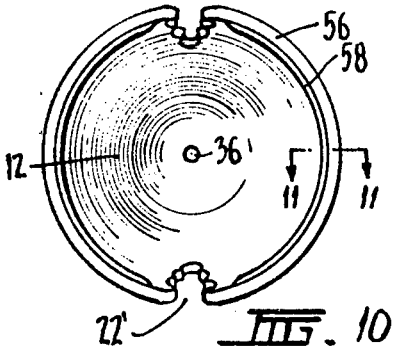
FIG. 10.
FIG. 11.
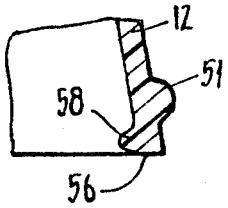

CLOTHES PEG

This invention relates to clothes pegs.

Clothes pegs are well known and generally comprise two leg portions hinged together by a stiff wire spring. Such pegs have a number of disadvantages in that they are easily lost and are subject to breakage by virtue of the leg portions becoming detached from the spring. This type of peg is also difficult to store in an orderly manner so that a user can easily account for the pegs when they are removed from a clothes line and placed into storage.

Further, conventional clothes pegs are often difficult to use when required to secure very bulky garments or the like to a clothes line.

The present invention may be said to reside in a clothes peg having a body portion, said body portion having a wall or walls, said wall or walls having at least two sets of openings, said sets of openings being spaced apart at a lower portion of the wall or walls, each of said sets of openings having a large lower region which communicates upwardly into a smaller upper region, such that, in use, at least two of the large lower regions are used to secure bulky garments to a clothes line by press fitting the peg over the bulky garment and clothes line so that the clothes line and garment enter the large lower region or at least two of the smaller upper regions are used to secure flimsy garments to the clothes line by press fitting the peg over the garment and clothes line so that the garment and clothes line passes the large lower region and fits into the smaller upper region.

Preferably, each of the sets of openings comprise a plurality of necked regions, provided one above the other and communicating with one another in a longitudinal direction of the peg, the necked regions commencing with the large lower regions at the bottom of the peg and ending with the smaller upper region.

Preferably, the peg has a retaining groove and ridge on the body portion to facilitate stacking of the pegs. Preferably, the body portion is a single conical member.

In a second aspect the invention provides a clothes peg having a hollow body portion, securing means associated with said body portion for attaching garments to a clothes line, said body portion having locking means such that when a plurality of pegs are stacked by placing the body portion of one peg over the body portion of another peg, said locking means releasably locks the pegs together.

Preferred embodiments of the invention will now be described with reference to the drawings in which:

FIG. 7 is a view from a base of a third embodiment of the invention, FIGS. 8 and 9 are side views of the embodiment of FIG. 7;

FIG. 10 is a bottom view of the embodiment of FIG. 7,

FIG. 11 is a view on line 11—11 of FIG. 10, and

FIG. 12 is a view partly in section or a number of pegs according to the embodiment of FIG. 7, stacked together.

Figure 1:
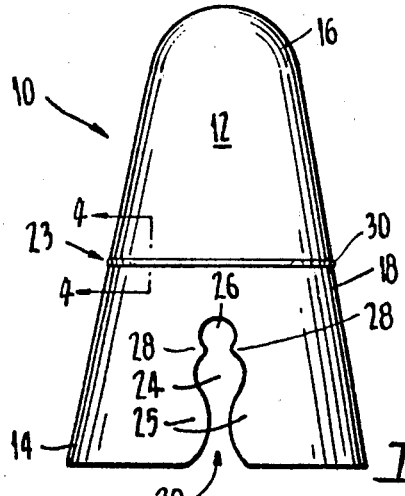
FIG. 1 is a front view of a peg embodying the invention.
Figure 2:
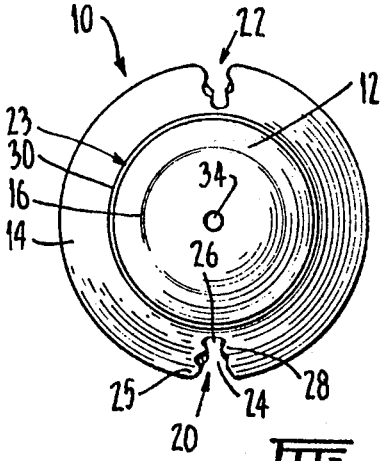
FIG. 2 is a plan view of the peg of FIG. 1.
Figure 3:
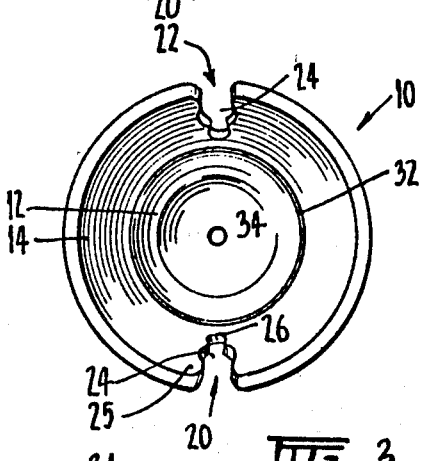
FIG. 3 is a view from beneath the peg of FIG. 1.

Referring to FIGS. 1 to 3, a peg 10 is shown which comprises a conical body 12 which tapers upwardly from a bottom portion 14 to a top portion 16. The conical body 12 consists of a tapering wall 18 capped with the top portion 16 which is generally hemispherical. The peg 10 is preferably moulded as an integral unit.

At least two sets of openings 20 and 22 are provided opposite each other in the bottom portion of the wall 18. Each of the sets of openings generally converges from a large bottom region 24 into a smaller upper region 26. In the embodiment of FIGS. 1 to 3 it can be seen that two regions 24 and 26 are provided.

The large bottom region 24 has a neck 25 which forms a constricted entrance into the region 24. Directly above the region 24 and in communication therewith is the smaller region 26. The smaller region 26 also has a neck 28 which forms a constricted entrance into the region 26.

Figure 4:
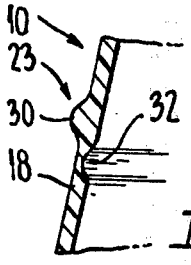
FIG. 4 is a cross-sectional view of a wall of the peg along the line 4—4 of FIG. 1.

The conical body 12 also has a circumferential groove and ridge 23 which is located slightly above the openings 20 and 22. As best seen in FIG. 4 the groove and ridge 23 is formed by ridge 30 on the outside of the peg and a groove 32, slightly below the ridge 30, on the inside of the peg.

The top portion 16 of the peg 10 has a small hole 34 which allows water to escape from the peg which may be trapped in the peg when the peg is in an inverted position.

In use, the peg 10 secures a garment or the like (not shown), to a clothes line (not shown), by placing the peg 10 over the garment and clothes line and press fitting the peg 10 over the garment and line so that they are retained in the openings 20 and 22 of the peg.

If the garment is a bulky article such as a woollen jumper, it will be retained securely in the large bottom regions 24 between the neck 25 and the neck 28. The peg 10 is preferably made from a plastics material so that the neck 25 will flex to allow the garment and clothes line to enter the large bottom region 24 and also retain the garment once located in the region 24.

If the garment is a flimsy garment such as a handkerchief, the garment is secured to the line by placing the peg over the garment and line, press fitting the peg onto the line so that the line passes the neck 25 and enters region 24. The peg is again pressed so that the line passes the neck 28 and enters the smaller region 26. It should be appreciated that it is possible, upon the selection of a filmsy article, to secure the article to the line in one action by simply pressing the peg over the line so that it passes neck 25, region 24 and neck 28 and enters region 28.

Figure 5:
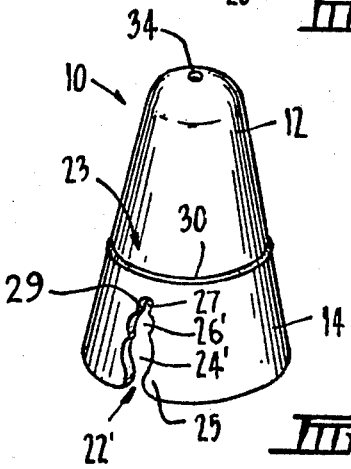
FIG. 5 is a view of a second embodiment of the invention.

FIG. 5 shows a further embodiment of the invention in which the opening 22' comprises three regions 24', 26' and 27. The smaller upper region in this embodiment is of course the region 27. This region 27 also has a neck 29 and is provided for use with an extremely thin clothes line.

Figure 6:
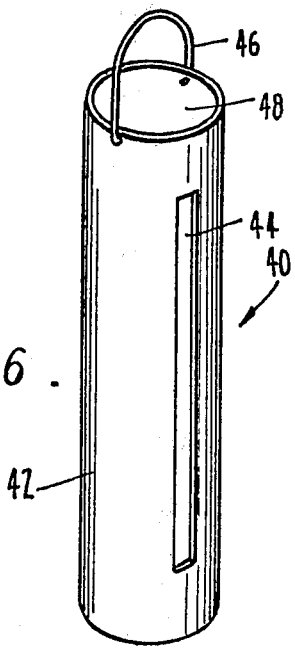
FIG. 6 is a view of a holder for containing and storing the pegs according to the preferred embodiments of the invention.

In FIG. 6, a holder 40 is shown for containing the pegs 10. The holder comprises a cylindrical tube portion 42, having a slot 44 and a handle 46. The slot 44 allows a user to readily determine the amount of pegs in the holder and also allows access to the pegs to put them towards the bottom of the tube 42.

The peg 10 may be stacked within the holder 40 by placing them through top openings 48, in inverted orientation so that top 16 enters the tube 42 first. It will be evident from FIGS. 1 to 5 that the pegs 10 will be easily stacked one on top of another due to their shape. The ridge 30 on the exterior of the peg 10 will engage with the groove 32 on the interior of another peg 10 when the pegs are stacked to lock the pegs together in the stack.

To remove a peg 10 from the holder, the stack of pegs (not shown) is readily moved down the tube 42 (if necessary) by placing a finger through the slot 44 and pushing downwards. The bottom peg is then gripped and pulled from the stack to disengage the peg from an adjacent peg and the frictional hold between the pegs and the side of tube 46.

In view of the presence of the ridge and groove 23 the pegs may be conveniently and securely stacked without the use of the holder 40.

However, the holder 40 provides a convenient package in which the pegs may be sold as well as a place to store pegs so that account may be kept of all pegs by simply noting if the holder is full after the pegs are removed from the clothes line.

Referring to the embodiment of FIGS. 7 to 11 in which like parts are numbered as described with reference to the embodiments of FIGS. 1 to 4.

In this embodiment, ribs 50 and 51 are provided at a lower portion of the peg 10 in the vicinity of openings 22' and small concentric ribs 52 are provided on the upper portion of the peg 10.

With particular reference to FIGS. 10 and 11, the bottom 56 of the conical body 12 has a flange 58 which projects inwardly with respect to the body 12. The flange 58 is for locking the rib 50 of another peg when the pegs are stacked, as in FIG. 12. In this regard, rib 50 is forced past the flange 58 and located therebehind. To release the stacked pegs, the ribs 51 of the bottom peg is pressed inwardly to release rib 50 from behind the flange 58 and the bottom peg is drawn from the stack.

The present invention provides the advantage that a garment may be secured to a line at two spaced apart locations (i.e. by openings 20 and 22). This allows a more secure connection of a garment to a clothes line.

Further, the convergence of the opening allows a secure connection with all garment sizes and line sizes. The convergence of the opening also tends to reduce the likelihood of the peg fracturing upwardly from the opening.

The pegs according to the preferred embodiment may also be conveniently stacked and stored.

A major advantage of the preferred form of the invention is that the pegs may be easily used by people suffering from arthritis and other ailments which may prevent normal use of the hands. This is because it is not necessary to squeeze the legs of a conventional peg together to open the peg. In the present embodiment, the peg is only required to be pushed onto a line.

Modifications may be made to the invention as would be apparent to persons skilled in the art, and such modifications are deemed to be within the scope thereof, the nature of which is to be determined from the foregoing description.

I claim:

1. A stackable clothes peg having a body portion with an open bottom end, said body portion tapering inwardly and upwardly from said open end so that one peg may be placed over another peg to allow the pegs to be stacked, said body portion having a rib extending at least about a portion of the periphery of said portion, said rib being located intermediate the open end of said peg and a top portion of said peg, said rib projecting outwardly of said body portion, said body portion having a flange adjacent the open end of said body portion, said flange projecting inwardly of said body portion such that a plurality of pegs may be stacked to be releasably locked together by placing one peg over another peg such that the flange on said one peg is forced over the rib on said another peg so that the flange is locked behind the rib and to release the stacked pegs a portion of said another peg adjacent the open end of said another peg is pressed inwardly to release the flange on said one peg from the rib on said another peg, said body portion also having securing means for attaching garments to a clothes line.

2. A stackable clothes peg according to claim 1 wherein said rib is an annular rib extending substantially about the entire periphery of said stackable clothes peg.

3. A stackable clothese peg according to claim 1 wherein said flange is an annular flange extending substantially about the inside of said body portion adjacent said bottom open end.

4. A stackable clothes peg according to claim 1 wherein said body portion is conical in shape.

5. A stackable clothes peg according to claim 1 wherein said securing means is comprised of at least two opposed openings in a lower section of a wall of said body portion, said openings tapering upwardly from a large opening to a smaller opening.

* * * * *